US008689689B2

(12) United States Patent
Cesak et al.

(10) Patent No.: US 8,689,689 B2
(45) Date of Patent: Apr. 8, 2014

(54) SYSTEM AND METHOD FOR MARKING SHEET MATERIALS

(75) Inventors: James Cesak, Westchester, IL (US); Arun Ramabadran, Naperville, IL (US)

(73) Assignee: Spraying Systems Co., Wheaton, IL (US)

( * ) Notice: Subject to any disclaimer, the term of this patent is extended or adjusted under 35 U.S.C. 154(b) by 1062 days.

(21) Appl. No.: 11/272,203

(22) Filed: Nov. 10, 2005

(65) Prior Publication Data

US 2006/0117980 A1 Jun. 8, 2006

Related U.S. Application Data

(60) Provisional application No. 60/627,218, filed on Nov. 12, 2004.

(51) Int. Cl.
*B05C 11/00* (2006.01)

(52) U.S. Cl.
USPC ..... 101/494; 101/335

(58) Field of Classification Search
CPC ..... B05B 12/12; B05B 12/082; B05C 11/00
USPC ..... 399/396; 101/335, 494
IPC ..... B31B 1/02; B05C 11/00
See application file for complete search history.

(56) References Cited

U.S. PATENT DOCUMENTS 2,111,761 A * 3/1938 Eckert ..... 427/188
2,300,488 A * 11/1942 Cuno ..... 52/420
2,384,420 A * 9/1945 Griswold ..... 417/316
2,971,370 A * 2/1961 Jacobs et. al. ..... 73/36
3,294,060 A * 12/1966 McIntyre et al. ..... 118/261
3,332,830 A * 7/1967 Tomlinson et al. ..... 428/190
3,402,695 A * 9/1968 Baker et al. ..... 118/674
3,567,476 A * 3/1971 Masciantonio et al. ..... 106/277
3,790,703 A * 2/1974 Carley ..... 358/296
3,890,048 A * 6/1975 Abbondio et al. ..... 356/425
4,670,761 A * 6/1987 Yoshino et al. ..... 347/14
5,027,706 A * 7/1991 Niemiro et al. ..... 101/366
5,370,745 A * 12/1994 Litteral ..... 118/669
5,415,351 A * 5/1995 Otto et al. ..... 239/345
5,503,735 A * 4/1996 Vinas et al. ..... 210/87
5,683,752 A * 11/1997 Popp et al. ..... 427/8
6,136,422 A * 10/2000 Lichtenberg et al. ..... 428/219

(Continued)

OTHER PUBLICATIONS

Rudolf J. Schick, An Engineers Guide to Drop Size, 1997, Bulletin No. 459, Spray Systems Co.*

*Primary Examiner* — Judy Nguyen
*Assistant Examiner* — Jennifer Simmons
(74) *Attorney, Agent, or Firm* — Leydig, Voit & Mayer, Ltd.

(57) ABSTRACT

An apparatus for applying a marking to an elongated sheet material is provided. The apparatus includes a processing machine through which an elongated length of the sheet material is passed. A marking system is arranged to apply a marking to the elongated length of sheet material passing through the processing machine. The marking system comprises at least one spray gun and a pump for supplying marking fluid to the spray gun. The pump is operable at selectively variable speeds. A controller controls the speed of the pump based upon a speed at which the sheet material is passed through the processing machine.

11 Claims, 4 Drawing Sheets

(56) References Cited

U.S. PATENT DOCUMENTS

| | | | | |
|---|---|---|---|---|
| 6,517,674 | B1 * | 2/2003 | Das | 162/135 |
| 6,635,134 | B1 * | 10/2003 | Lichtenberg et al. | 156/162 |
| 2002/0060407 | A1 * | 5/2002 | Braun et al. | 271/195 |
| 2003/0202055 | A1 * | 10/2003 | Jeanmaire et al. | 347/82 |
| 2004/0107663 | A1 * | 6/2004 | Waggoner | 52/518 |
| 2004/0121082 | A1 * | 6/2004 | Dunnous et al. | 427/421 |
| 2006/0029742 | A1 | 2/2006 | Cesak et al. | |
| 2006/0286290 | A1 * | 12/2006 | Wanthal et al. | 427/8 |

* cited by examiner

SYSTEM AND METHOD FOR MARKING SHEET MATERIALS

CROSS-REFERENCE TO RELATED APPLICATIONS

This patent application claims the benefit of U.S. Provisional Patent Application No. 60/627,218, filed Nov. 12, 2004

FIELD OF THE INVENTION

This invention pertains generally to the manufacture and processing of products made from a moving web or other continuous sheet material, and more particularly, to an apparatus and method for applying markings onto the moving sheet material.

BACKGROUND OF THE INVENTION

Often it is necessary to provide markings on various web or sheet formed products. Preferably, the markings are applied to the web or sheet products as they are undergoing other processing. For example, roofing materials, such as asphalt shingles, commonly are produced in a process line in which a web of sheet material, made of organic or fiberglass material, is drawn from a supply roll through (1) a coating station in which the web is coated with a hot liquid tar or asphalt, (2) a surfacing station in which granular surfacing material is directed onto the hot liquid coating, (3) a cooling and press roll station in which the granular surface material is pressed into the hot liquid coating and sheet material and coating are cooled by spraying a cooling liquid onto the moving sheet material and (4) cutting and stacking stations in which the cooled sheet material is cut into predetermined-size shingles and stacked.

Roofing products include a variety of different shingles and rolls each of which is designed to be nailed down in a particular location. In order to help the roofers who install the products determine where a particular roofing product should be nailed, roofing material processing lines can include a nail marking system. A typical nail marking system uses one or more marking wheels to apply a rough line that runs the length of the roofing product identifying where the particular roofing product should be nailed. The marking wheels pick-up the marking fluid, which is a mixture of industrial latex paint and water, from a trough to which the marking fluid is pumped. Known water/paint mixtures used as marking fluids have water to paint mix ratios of 70/30 to 40/60.

Roofing material processing lines are now running at faster and faster speeds as compared to in the past with most roofing material lines running at close to 750 ft/min. Unfortunately, at higher speeds, the line produced by the marking wheel in conventional nail marking systems can include skips or become crooked, ragged and/or faint. Because improperly marked roofing products must be scrapped or rejected, failure of the marking system can be expensive and time consuming.

In addition, nail marking systems using applicator wheels are quite messy and relatively labor intensive and expensive to maintain. For example, because of paint build-up, the applicator wheels have to be cleaned and replaced on a regular basis. Moreover, the paint used in the marking fluid is relatively expensive. However, it is difficult to monitor and control paint utilization with wheel and trough marking systems leading to further inefficiencies.

BRIEF SUMMARY OF THE INVENTION

The invention provides an apparatus for applying a marking to an elongated sheet material. The apparatus includes a processing machine through which an elongated length of the sheet material is passed. A marking system is arranged to apply a marking to the elongated length of sheet material passing through the processing machine. The marking system comprises at least one spray gun and a pump for supplying marking fluid to the spray gun. The pump is operable at selectively variable speeds. A controller controls the speed of the pump based upon a speed at which the sheet material is passed through the processing machine.

DETAILED DESCRIPTION OF THE INVENTION

Figures 1A, 1B:
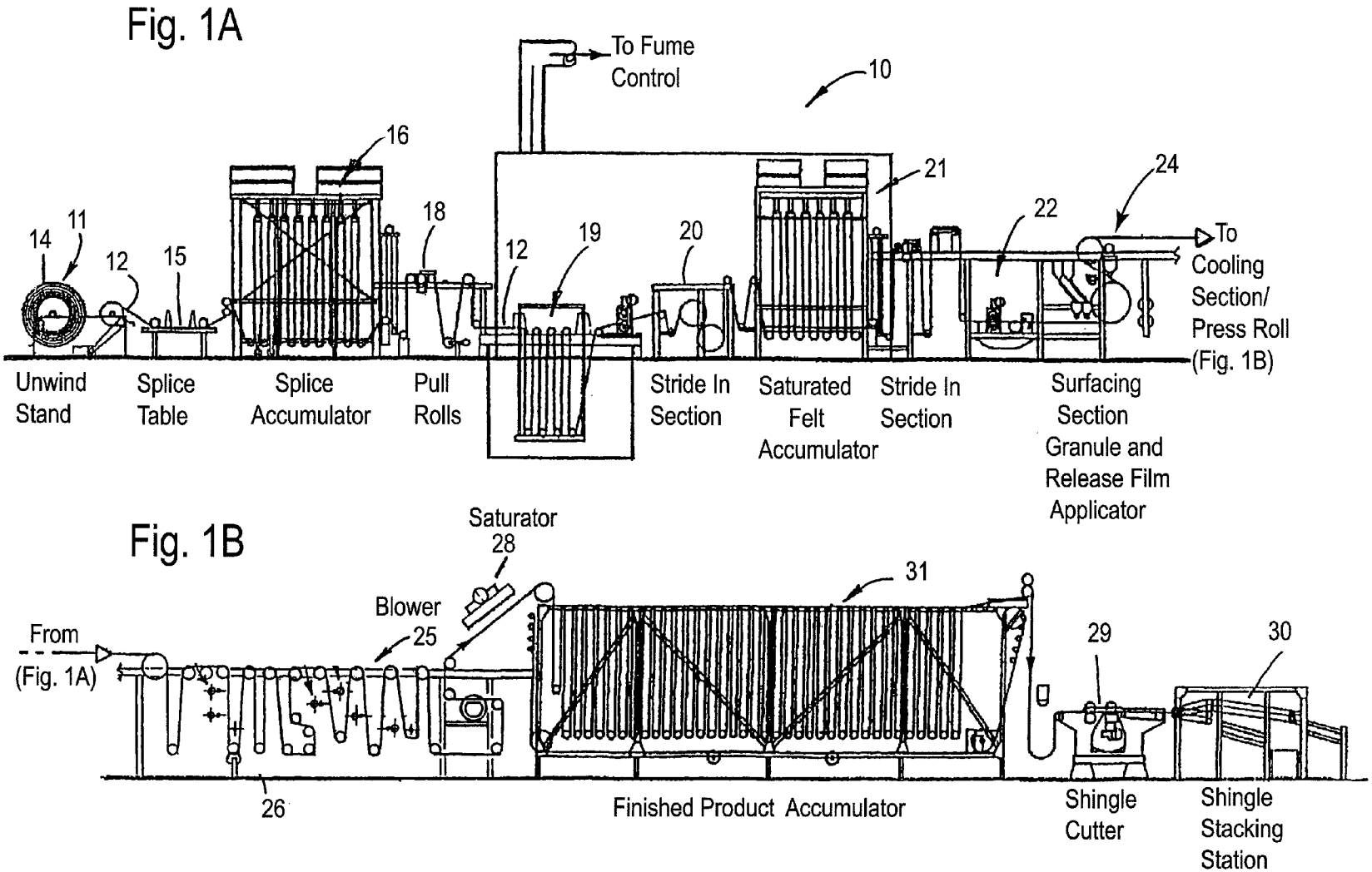
FIGS. 1A and 1B are a diagrammatic depiction of an illustrative asphalt shingle processing line having a marking system in accordance with the invention.

Referring now more particularly to FIGS. 1A and 1B of the drawings, there is shown an illustrative roofing material processing line 10, in this case a shingle processing line, including a marking system in accordance with the present invention. While the present invention is described in connection with producing a generally continuous nail marking line on a web of roofing material, and in particular a web of roofing shingles, it will be understood by those skilled in the art that the present invention is not limited to roofing material processing lines or applications in which a continuous marking line is applied to a material. To the contrary, the present invention can be used in any application in which it may be desirable to place some sort of mark on a web or sheet material.

The illustrated asphalt shingle processing line 10 basically is of a conventional type. In this case, the processing line 10 includes an unwind stand 11 in which a spool of a continuous web or sheet material 12, such as fiberglass or felt, is drawn from a takeout roll 14 over a splicing table 15 and through an accumulator 16 by means of pull rolls 18. The web 12, as shown in FIG. 1A, is directed in serpentine fashion through the accumulator 16, in which upper rolls thereof can be raised and lowered in a known manner for providing a continuous supply of sheet material to the processing line 10 notwithstanding any breakage or an interruption in the supply of material from the takeout roll 14. The web 12 is then drawn through a saturator 19 which coats both sides of the web with hot asphalt or tar. The coated web is then directed via a feed station 20 to a further accumulator 21 then directed via a stride-in section 22 to a surfacing section 24 where granular material is released onto the hot-coated web. The surfaced web 12 is thereupon directed to a cooling and press roll station 25 (FIG. 1B) that initially cools the coating and sheet material prior to direction through a press roll 26. The web is then cooled in the cooling section 25 and dried by a blower 28, prior to direction to a shingle cutting and shingle stacking stations 29, 30 via a finished product accumulator 31. Additional details regarding the construction and operation of the shingle processing line can be found in commonly owned U.S. application Ser. No. 10/910,842, the disclosure of which is incorporated herein by reference.

In accordance with the present invention, for producing a mark on the roofing material, in this case a line that runs the length of the roofing product identifying where the shingles should be nailed, the illustrated shingle processing line 10 includes a marking system 32 in which the application rate of the marking fluid can be controlled on the basis of the speed of the processing line 10. As described in greater detail below, unlike conventional wheel and trough marking systems that produce ragged edged, uneven lines at higher line speeds, the marking system 32 of the present invention is able to provide a clean, distinct line of consistent width across a wide range of processing line speeds. Moreover, the marking system 32 of the present invention can be operated at relatively low paint to water ratios leading to significant cost savings (because of the use of less paint) as compared to conventional wheel and trough marking systems.

Figure 2:
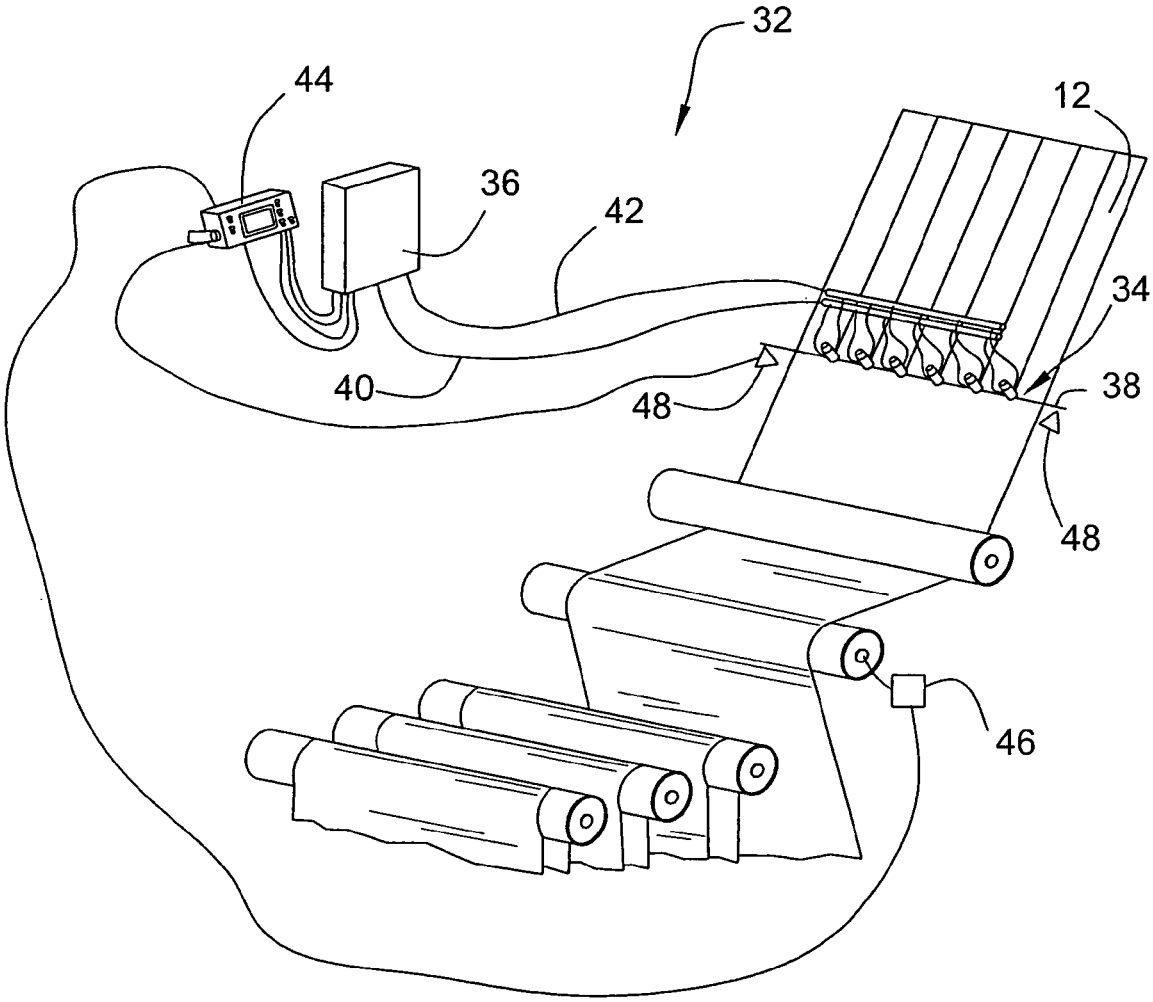
FIG. 2 is a perspective diagrammatic depiction of a portion of the shingle processing line of FIGS. 1A and 1B showing the marking system of the invention situated before the finish product accumulator or looper.

To this end, the marking system 32 includes a plurality of spray guns 34 that are supplied with marking fluid via a pump 36, in this case a positive displacement gear pump, as shown in FIG. 2. Advantageously, the positive displacement gear pump 36 can quickly change speeds, thus allowing the flow rate out of the spray guns 34 to be adjusted quickly based on the speed of the shingle processing line 10. For example, the pump 36 can be operated at a higher speed so as to provide a higher flow rate through the spray guns 34 when the processing line 10 is operating at higher line speeds to ensure that the nail marking line is clear and distinct. Conversely, at slower line speeds, such as during start-up or shut-down, the pump 36 can be operated more slowly so that only the amount of marking fluid necessary to produce a clear distinct line is directed through the spray guns 34. Accordingly, the use of the positive displacement pump 36 allows the marking system 32 to accurately meter the marking liquid onto the shingles across a relatively wide range of line speeds. This not only results in a clear visible marking line even at high processing line speeds, but also optimizes usage of the marking fluid by ensuring that excess marking fluid is not applied at slower line speeds.

Figure 3:
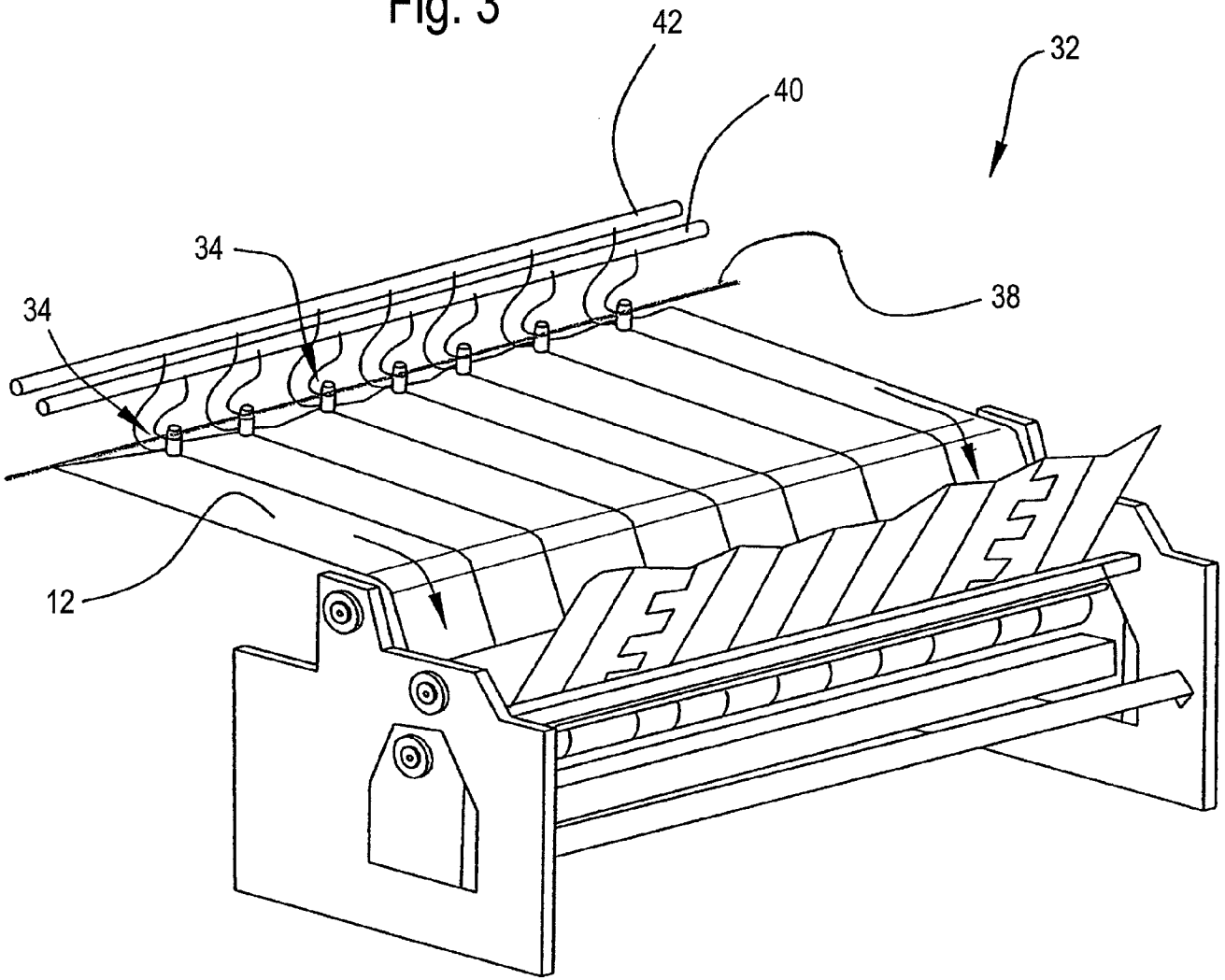
FIG. 3 is a perspective diagrammatic depiction of a portion of the shingle processing line of FIGS. 1A and 1B showing the marking system of the invention situated before the shingle cutter.

The illustrated spray guns 34 are supported on a header 38 arranged, in this case, above the moving web 12 of roofing shingles. As will be appreciated by those skilled in the art, the spray guns 34 are arranged on the header 38 so that the marking fluid discharged by each of the spray guns 34 hits the moving web 12 in a desired location so as to produce a continuous marking line along the web identifying where the finished shingles should be nailed. In the embodiment illustrated in FIG. 2, the spray gun header 38 is arranged so as to situate the spray guns 34 above the shingle web 12 just downstream of the cooling section 25 and upstream of where the shingle web enters the finished product accumulator 31. Alternatively, as shown in FIG. 3, the spray gun header(s) 38 for the nail marking system 32 can be further downstream in the processing line 10 just before the shingle cutter 29. Of course, the marking system 32 of the present invention is not limited to any particular location in the shingle processing line 10.

Each spray gun 34, in this case, is a pneumatic spray gun 34 equipped with a solid stream type spray nozzle. The spray nozzles can be selected so as to provide a marking line of the desired width, e.g. 0.125 in. One suitable type of spray nozzle is the ¼JAU automatic spray gun available from Spraying Systems, the assignee of the present invention. In the illustrated embodiment, each spray gun 34 has lines connecting to a common marking fluid supply line 40 and a common pressurized air line 42 (see FIG. 2). The pressurized air line 42 controls operation, i.e. opening and closing, of the spray guns 34 in a known manner (in the embodiment illustrated in FIG. 2, the pneumatic system and the pump 36 are integrated into a single unit). The marking fluid supply line 40 provides the marking fluid to the spray guns 34. As previously discussed, flow of the marking fluid through the fluid supply line 40 is controlled by the positive displacement pump 36.

To control the pump 36 as well as monitor other operational parameters of the marking system 10, a controller 44 can be provided. In order to monitor the speed of the processing line 10, the controller 44 can be in communication with one or more line speed sensors associated with the shingle processing line. A shingle processing line typically includes one or more such sensors with which the controller can communicate. For example, the processing line 10 can include a speed sensor 46 arranged to detect the rotational speed of the one of the rollers that can be in communication with the controller 44 as diagrammatically depicted in FIG. 2. The controller 44 is also in communication with the pump 36 and programmed so as to adjust the speed of the pump based on the processing line speed as sensed by the one or more line speed sensors. One example of a controller suitable for use in the marking system of the present invention is the AutoJet Model 2250 spray controller available from Spraying Systems, the assignee of the present invention.

The controller 44 can also provide fault or warning signals or other information associated with the operation of the marking system 10. For example, with the system of the present invention, the positive displacement pump 36 acts as a virtual flow meter allowing for much closer monitoring of the paint utilized by the system. In particular, the positive displacement pump 36 monitors the set point or reference flow rate through the spray guns 34 and reports that information to the controller 44. The controller 44 can be adapted to display the flow rate and the line speed so that the shingle processing line operators are able to monitor the amount of marking fluid being consumed by the system. In addition, the controller 44 can compare the reference flow rate as measured by the positive displacement pump 36 to a theoretical or predetermined desired flow rate for the system. In such as case, the controller 44 can be programmed to provide a high or low flow alarm if the measured flow rate exceeds the theoretical or predetermined flow rate for a predetermined period of time.

To further ensure the application of a clear and distinct mark on the roofing materials, the marking system 32 can include flow sensors 48 arranged to monitor the discharge from the spray guns 34. The flow sensors 48 can be used to detect whether the spray guns 34 are actually spraying or whether the discharging spray is wobbling or drooping (due, for example, to a partially clogged spray gun) in such a manner that the marking line is not being applied to the moving web correctly. The flow sensors 48 can communicate with the controller 44 or some other device capable of providing a warning signal when the flow from one or more of the spray guns 34 has stopped, is wobbling or drooping. This warning signal can allow the shingle processing line operators to take appropriate actions to minimize product loss due to plugged nozzles or spray wobble or droop by warning the operators so that they can take appropriate action.

Figure 4:
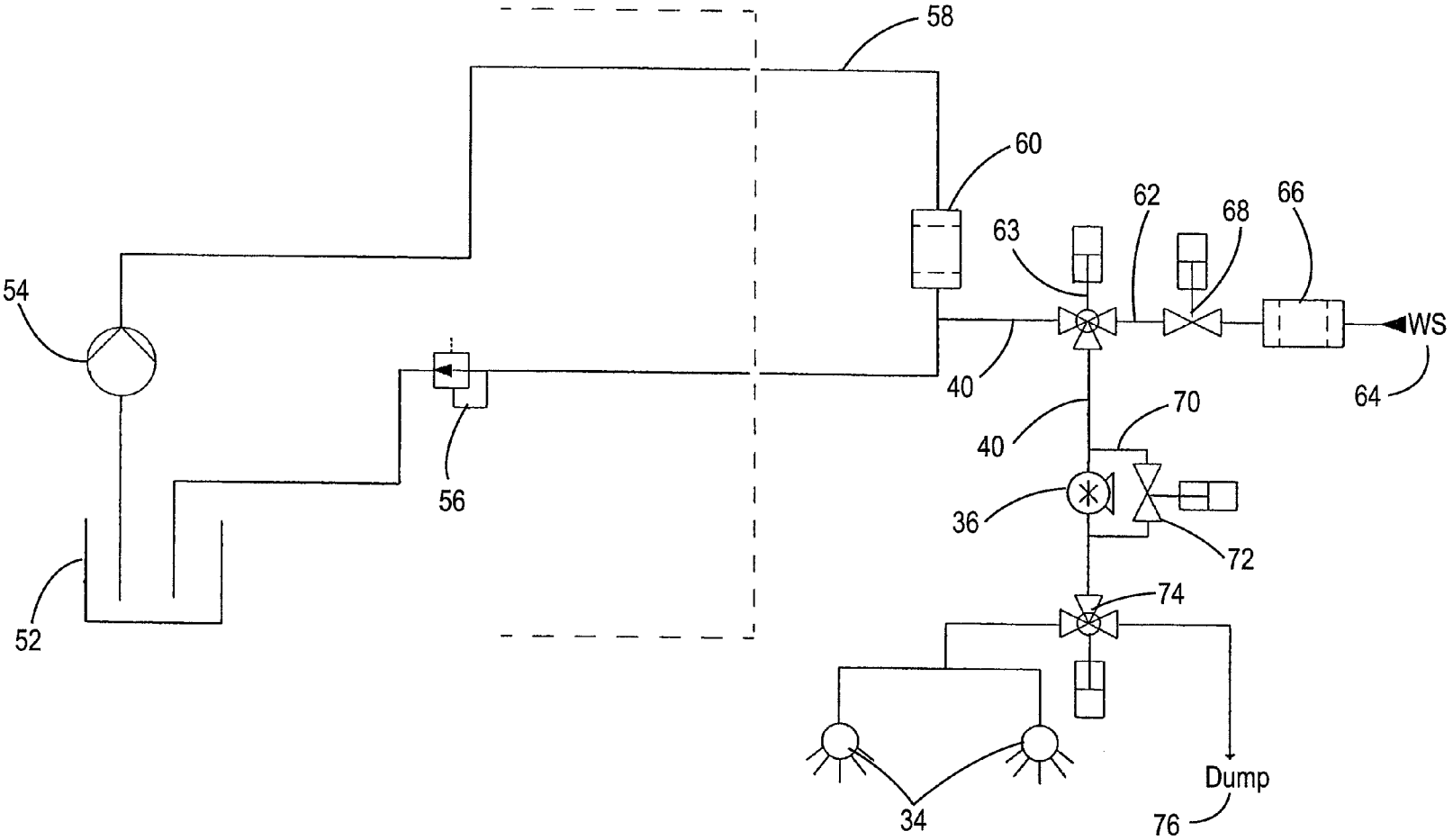
FIG. 4 is a schematic diagram of an exemplary marking fluid circulation system for the marking system of the invention.

To help clean-out the system when it is shut down, the marking system 32 of the present invention can be configured to execute a quick system flush. The system flush mode can be executed quickly (e.g., 5-7 seconds) by directing one or more bursts of a flushing liquid such as water through the system. FIG. 4 is a schematic diagram of an exemplary piping system for the marking system of the present invention as equipped with such a system flush mode. The illustrated system includes a closed loop marking fluid supply system including an agitated marking fluid supply tank 52, a marking fluid supply pump 54, a backpressure regulator 56 and a marking fluid circulation line 58. Branching off of the marking fluid supply system is the marking fluid supply line 40 to the spray guns 34. In this case, a filter 60 is provided just upstream of where the marking fluid supply line 40 branches off of the marking fluid circulation line 58. A flushing fluid supply line 62 also connects to the marking fluid supply line 40 via a three-way control valve 63. The flushing fluid supply line 62 is part of a flushing fluid system including, in this case, a water supply 64, a filter 66 and a flush valve 68.

As shown in FIG. 4, the positive displacement pump 36 is arranged downstream from the three-way control valve 63. A bypass line 70 having a bypass control valve 72 extends around the positive displacement pump 36. A second three-way control valve 74 is arranged downstream of the positive displacement pump and the location where the bypass line 70 rejoins the marking fluid supply line 40. The second control valve 74 can direct flow either to a dump tank 76 or to the spray guns 34. In normal operation, the first three-way control valve 63 would be set to block fluid flow from the flushing fluid supply line 62, the bypass control valve 72 would be closed and the second three-way control valve 74 would be set to block fluid flow to the dump tank 76. In the system flush mode, the first three-way valve 63 would switch to block flow from the marking fluid supply system and allow fluid flow from the flushing fluid supply line 62. Additionally, the bypass control valve 72 would open and the second three-way control valve 74 would switch to block flow to the spray guns 34 and open flow to the dump tank 76.

Advantageously, the system flush will clean out most of the marking system piping upstream of the spray guns leaving only the spray guns themselves to be cleaned out manually. A flush mode is particularly useful in situations where the line between the pump and the spray guns is relatively long. According to one preferred embodiment, the switch to a system flush mode can be controlled by the controller and automated based on the occurrence of a triggering event associated with operation of the shingle processing line such as an interruption in the movement or breakage of the web.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. An apparatus for marking finished processed sheets with reference lines for facilitating subsequent manual handling or installation of the finished sheets comprising:

a supply of an elongated length of sheet material;

a processing line for conveying and processing the elongated length of sheet material;

said processing line being operable for conveying said sheet material through the processing line at conveying speeds up to at least about 750 feet per minute;

said processing line including a plurality of processing stations including a cutting station for cutting the elongated length of sheet material into predetermined sized finished sheets;

a supply of a liquid paint marking fluid;

a marking system arranged to apply said liquid paint marking fluid to the elongated length of sheet material passing through the processing line prior to said cutting station, the marking system comprising at least one stationaryly mounted liquid directing spray device having a solid stream liquid spray nozzle for discharge and direction without pressurized air atomization a narrow pressurized liquid stream of said liquid paint marking fluid with liquid paint marking fluid throughout a spray pattern for providing a straight external marking and reference line parallel to the longitudinal length of the sheet material identifiable on the finished sheets following completion of processing of the finished sheets for enabling a user to reference the marking and reference line during subsequent handling or installation of the finished sheets, said spray device being operable for directing the pressurized liquid stream of the liquid paint marking fluid directly onto the passing elongated sheet material, a variable speed positive displacement pump for supplying metered quantities of said liquid paint marking fluid to the spray device as an incident and in direct relation to the operating speed of the positive displacement pump, said pump being operable at selective variable speeds;

a sensor for detecting the speed at which the sheet material is passed through the processing line, said sensor being in communication with a controller, said controller being operable for controlling the speed of the positive displacement pump based upon a speed at which the sheet material is passed through the processing machine such that the liquid paint marking fluid is sprayed onto the moving sheet material in direct relation to the operating speed of the positive displacement pump, and said liquid spray nozzle being operable for spraying the liquid paint marking fluid onto the moving sheet material to form a uniform clearly distinct visible marking and reference line of consistent width of about 0.125 inches on the moving sheet material at a speed of sheet material movement of about 750 feet per minute.

2. The apparatus according to claim 1 wherein the spray device is one of a plurality of spray guns arranged on a header above the moving sheet material, said spray guns each being operable for spraying a separate marking and reference line in distinct and separated spaced relation to the marking and reference line sprayed by the other spray guns.

3. The apparatus according to claim 1 wherein the spray device is a pneumatically operated spray gun.

4. The apparatus according to claim 1 wherein the pump monitors the flow rate through the spray device and communicates the flow rate to the controller.

5. The apparatus according to claim 1 further including a flow sensor arranged to monitor the discharge from the spray device, the flow sensor being in communication with the controller.

6. The apparatus according to claim 1 further including a flush system comprising a flushing fluid supply and a flushing fluid dump in fluid communication with the marking system, the flushing system being selectively operable to direct flushing fluid from the flushing fluid supply through at least part of the marking system to the flushing fluid dump.

7. The apparatus of claim 1 in which said supply of liquid paint marking fluid is a supply of a water based paint.

8. The apparatus of claim 1 in which said processing line includes a coating station that coats said sheet material with hot liquid asphalt.

9. An apparatus for making finished roofing shingles that are mounted by nailing onto a roof or like support surface comprising:

a supply of an elongated length of sheet material;

a processing line for conveying and processing the elongated length of sheet material;

said processing line being operable for conveying said sheet material through the processing line at conveying speeds up to at least about 750 feet per minute;

said processing line including a coating station in which the sheet material is coated with a liquid coating, a surfacing station in which granular surfacing material is directed onto the liquid coating, a pressing station in which the granular material is pressed into the coating material, and a cutting station for cutting the elongated length of sheet material into predetermined sized finished shingles;

a supply of a liquid paint marking fluid;

a marking system arranged to apply said liquid paint marking fluid to the elongated length of sheet material passing through the processing line after the surfacing station, the marking system comprising at least one stationaryly mounted liquid directing spray device having a solid stream liquid spray nozzle for discharge and direction without pressurized air atomization of a narrow pressurized liquid stream of said liquid paint marking fluid with liquid throughout a spray pattern that forms a straight external marking and reference line parallel to the longitudinal length of the sheet material identifiable on the finished shingles following completion of processing of the finished shingles for providing an external visual reference to the location where the finished shingles are to be nailed to the roof or support surface, said spray device being operable for directing the pressurized liquid stream of the liquid paint marking fluid directly onto the passing elongated sheet material, a variable speed positive displacement pump for supplying metered quantities of said liquid paint marking fluid to the spray device as an incident and in direct relation to the operating speed of the positive displacement pump, said pump being operable at selective variable speeds;

a sensor for detecting the speed at which the sheet material is passed through the processing line, said sensor being in communication with a controller, said controller being operable for controlling the speed of the positive displacement pump based upon a speed at which the sheet material is passed through the processing line such that the liquid paint marking fluid is sprayed onto the moving sheet material in direct relation to the operating speed of the positive displacement pump, and said liquid spray nozzle being operable for spraying the liquid paint marking fluid onto the moving sheet material to form a uniform clearly distinct visible marking and reference line of consistent width of about 0.125 inches on the moving sheet material at a speed of sheet movement of about 750 feet per minute.

10. The apparatus according to claim 9 wherein the spray device is one of a plurality of spray guns arranged on a header above the moving sheet material, said spray guns each being operable for spraying a separate marking and reference line in distinct and separated spaced relation to the marking and reference line sprayed by the other spray guns.

11. The apparatus of claim 9 in which said supply of liquid paint marking fluid is a supply of a water based paint.

* * * * *